US006895877B1

(12) United States Patent
Weiner

(10) Patent No.: US 6,895,877 B1
(45) Date of Patent: May 24, 2005

(54) SELECTIVE ELEVATION OF PARTICULAR YARNS FED THROUGH A SINGLE NEEDLE METHOD AND APPARATUS

(75) Inventor: Robert S. Weiner, Atlanta, GA (US)

(73) Assignee: Product Concepts Residential, L.L.C., Dalton, GA (US)

( * ) Notice: Subject to any disclaimer, the term of this patent is extended or adjusted under 35 U.S.C. 154(b) by 0 days.

(21) Appl. No.: 10/987,062

(22) Filed: Nov. 12, 2004

(51) Int. Cl.[7] ..... D05C 15/18; D05C 15/26; D05C 15/32; D05C 15/34

(52) U.S. Cl. ..... 112/80.7; 112/302

(58) Field of Search ..... 112/80.7, 80.73, 112/80.23, 80.01, 163, 254, 302, 475.23

(56) References Cited

U.S. PATENT DOCUMENTS 5,094,178 A * 3/1992 Watkins ..... 112/80.73
5,383,415 A * 1/1995 Padgett, III ..... 112/80.73 X
6,446,566 B1 * 9/2002 Bennett et al. ..... 112/80.73

* cited by examiner

*Primary Examiner*—Peter Nerbun
(74) *Attorney, Agent, or Firm*—Stephen J. Stark; Miller & Martin PLLC

(57) ABSTRACT

A tufting machine utilizing a plurality of yarn ends proceeding through a single needle cooperates with a yarn tension device which selectively applies a different tension to at least one of the plurality of yarn ends proceeding through the needle. Accordingly, a pattern or design can be provided in tufted fabric as the lower tension (higher speed) yarn ends will extend a higher distance from a fabric than lower tension yarn ends.

14 Claims, 2 Drawing Sheets

SELECTIVE ELEVATION OF PARTICULAR YARNS FED THROUGH A SINGLE NEEDLE METHOD AND APPARATUS

BACKGROUND OF THE INVENTION

This invention relates to textile machinery and its use, and more particularly to textile manufacturing machines such as tufting machines, warping machines and the like utilized with a creel or other yarn or yarn-type supplies which provide a plurality of yarn strands fed through a single yarn guide such as an eye of a needle in textile machinery.

In textile machines, such as tufting machines, yarn is normally fed to the machinery either directly from a creel or from a warper. A creel is a frame having an array of vertical and horizontal support members including a multiplicity of yarn cone holders. A yarn cone is a spool about which yarn is wound. There are a multiplicity of yarn cone holders provided in horizontally and vertically disposed pairs, one cone holder of the pair mounting the active yarn cone and the other mounting a reserve or magazine cone used after the active cone is emptied. Each cone holder pair normally has its own yarn guide tube through which yarn on each holder of the pair may be fed. While this is the standard arrangement for creels, other creel configurations could also be utilized for tufting machines.

A warper is normally a machine having a large spool, known in the art as a beam, on which yarn is wound and which subsequently supplies the yarn to a tufting machine. These may have more than one yarn wound thereabout and even a plurality of beams may be utilized such as mini-beams as described in U.S. Pat. No. 6,592,069.

In the art of tufting, generally a strand of yarn is fed through each needle. However, there are some occasions when it may be desired to feed a plurality of fine yarn strands to each needle for providing tufted fabrics having unique patterns. Presently, when such need arises, and in order to supply more than one yarn strand to a needle of a tufting machine, the yarn strands are cabled together onto a single yarn cone or to reserve a magazine position as used for mounting an active cone. Cabling involves winding the plural yarns onto a single yarn cone, but yarn manufacturers typically merchandise yarn cones with but a single yarn wound thereon. Thus, cabling requires unwinding the yarn cones from several cones and rewinding the yarns as a group on the multi-yarn cones. Cabling is therefore believed to be inconvenient and time consuming. Magazining, on the other hand, would appear to limit to two the number of yarn strands capable of being used and thus limits the pattern potential.

In an effort to overcome the disadvantages of the prior art, U.S. Pat. Nos. 5,531,392 and 5,613,643, incorporated by reference, are directed to providing multiple yarn strands to a single yarn guide tube. This is believed to be a huge advance over the prior art. Where multiple yarns are provided through the method and apparatus taught in U.S. Pat. Nos. 5,531,392 and 5,613,643, they often result in a relatively random pattern of yarn color as the multiple yarns can be twisted during the feeding process to the tufting or other textile machine. Normally this is a desirable effect. However, if the manufacturer desires to have more control on the colors displayed on a finished product such as a repeating pattern or design, the current technology provides no solution. Control of which textures and/or colors of multiple yarns passing through a particular needle is predominantly displayed is currently not believed to be possible utilizing any of the currently known methods to the applicant.

SUMMARY OF THE INVENTION

Consequently, it is a primary object of the present invention to provide a yarn supply such as a creel or plurality of beams which feed a plurality of yarn strands for use by a needle of a tufting machine or other textile machinery either directly or indirectly wherein at least one of the yarn strands may be selectively elevated in the finished product.

It is another object of the present invention to provide a yarn supply which provides a plurality of yarns to a single needle wherein the at least one of the plurality of yarns is provided at a tension which differs from the tension from others of the plurality of yarn strands.

It is another object of the present invention to provide a yarn supply which feeds yarns to a tensioning apparatus such as a servo scroll, scroll device, or other device so that at least one of the plurality of yarn ends can be selectively fed at a tension which differs from the remainder of the others of the plurality of yarn strands.

Accordingly, the present invention provides a yarn supply for feeding yarn to a textile machine such as a tufting machine wherein a plurality of yarn ends are fed to a single needle of the textile machine. Intermediate the yarn supply and the needle is a tension apparatus such as a scroll, servo scroll, or other tensioning device which preferably is configured to selectively and separately apply tension to each of the plurality of strands proceeding to the needle.

Accordingly, depending on the tension of each of the plurality of yarn strands proceeding to a particular needle, a higher or lower loop may then be created. A looper such as a cut/loop looper may be useful in some applications. A tension controller such as a yarn feed attachment or other textile machine accessory can then preferentially dictate the uppermost of the plurality of yarn strands visible from above to thereby allow the creation of a finished product so that patterns and/or designs may be created by the selective tensioning and looping and/or cutting of yarn ends provided from a single needle to produce a desired finished effect.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
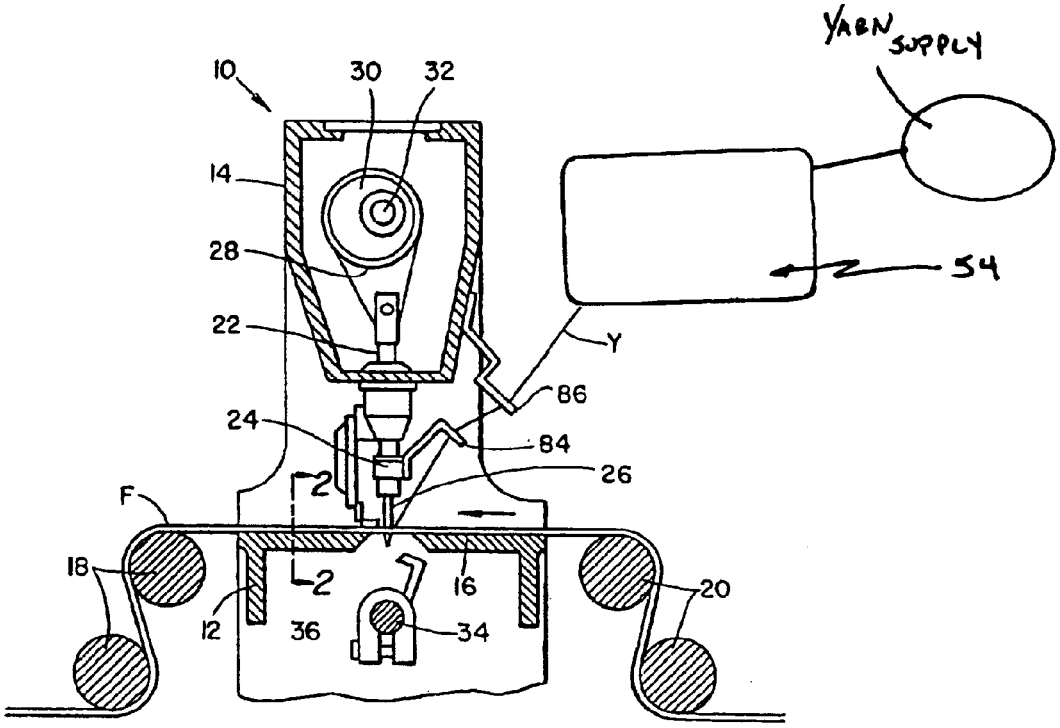
FIG. 1 shows a textile machine, namely a tufting machine, equipped with a tensioning apparatus, namely, a servo scroll attachment fed from a yarn supply such as a creel.

FIG. 1 is a diagrammic view showing a tufting machine 10 having a frame comprised of a bed 12 and a head 14 disposed above the bed 12. The bed includes a base plate 16 across which a fabric F is adapted to be fed by a pair of feed rolls 18 and take-off rolls 20.

The bed includes a base plate 16 across which a fabric F is adapted to be fed by a pair of feed rolls 18 and take-off rolls 20. Mounted in the head 14 for vertical reciprocation is one of a plurality of push rods 22 to the lower end of which a needle bar 24 is carried, the needle bar being mounted for lateral or transverse sliding movement relative to the direction of reciprocation of the push rods and transverse to the direction of feed of the fabric F. The needle bar 24 carries a plurality of needles 26 that are adapted to penetrate the fabric F on the bed plate 16 upon reciprocation of the needle bar 24 to project loops of yarn therethrough. End wise reciprocation is imparted to the push rods 22 and thus the needle bar 24 and needles 26 by, for example, a link 28 which is pivotably connected at its lower end to the push rods 22 and at its upper end to an eccentric 30 on a driven rotary mainshaft 32 journally mounted longitudinally in the head 14. Journalled beneath the bed plate 16 is an oscillating hook or looper shaft 34 which is arranged parallel to the mainshaft 32 and which carries a plurality of hooks or loopers 36. Each hook or looper 36 cooperates with a respective needle 26, the particular needle cooperating with a particular hook or looper being determined upon the lateral or transverse position of the needle bar 24. While, to simplify the disclosure, only a single needle 26 and single hook or looper 36 is shown, it is understood that a multiplicity of such elements are provided laterally across the machine, and that the number may be upwards of 1,000 of such elements. Furthermore, the looper 36 may also be a cut/loop looper so that the tension of inserted yarn affects the height of the loop and/or whether the loop is cut as described in U.S. Pat. No. 5,509,364, incorporated by reference, or other such device.

While the applicant has successfully marketed and sold carpet designs manufactured using the creels of U.S. Pat. Nos. 5,531,392 and 5,613,643, a need has arisen to selectively elevate at least one of the plurality of yarn strands relative to the others which proceed through a single needle 26.

Figure 2:
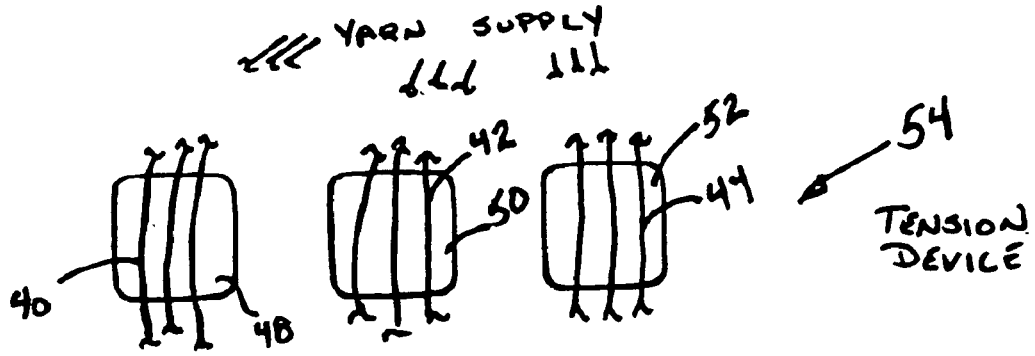
FIG. 2 is a fragmentary perspective view illustrating a manner in which yarn strands from a yarn supply are directed across at least two independently controllable tensioning members of a tensioning device, then fed through a single needle of a textile machine such as a tufting machine and then proceed relative to a looper configured to assist in elevating at least one selected of the plurality of yarns relative to the remainder of the plurality of yarns.
Figure 2:
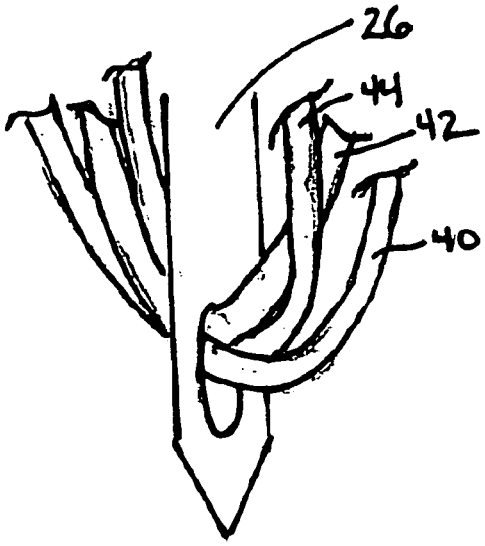

FIG. 2 shows a plurality of yarn ends 40,42,44 proceeding through an eye 46 of needle 26. In the prior art, all of the plurality of yarn ends 40,42,44 were supplied at the same tension to each needle such as from a single tension member. Accordingly, all of the yarn ends 40,42,44 fed to a particular needle 26 cooperated with a looper 36 in an identical manner depending on the feed of the yarn ends 40,42,44 to that needle 26. It was possible to select high or low loops, but all of the plurality of yarn ends were fed with identical tension for a given needle 26.

The applicant has discovered that it is possible to select the tension of any of the plurality of yarn ends 40,42,44 proceeding to a particular needle 26. This can be done by providing yarn ends 40,42,44 from separate members 48,50, 52 of a yarn tensioning apparatus 54 such as from separating controlled clutches on a scroll yarn feed attachment. In this configuration a repeat will be established (i.e., such as with a Velvaloop(™) or Forenzi(™) attachment), but if a CMC (™), Infinity(™) or other individual yarn end tension control type device were selected, then a design rather than a repeating pattern could be created as will be explained in further detail below.

The yarn ends 40,42,44 are provided to the yarn tension control device 54 from a yarn supply 56. The yarn supply 56 could be a creel, warper or other supply.

In accordance with the new method of the applicant, a plurality of yarn ends 40,42,44 illustrated as three yarn ends, but understood to be at least two, are provided to a yarn tension control device 54 having the capability of selectively providing a different tension to at least one of the plurality of yarns 40,42,44. This is done in the preferred embodiment by varying the speed of at least one of members 48,50,52 relative to the others of the members 48,50,52 which are providing yarn ends 40,42,44 to a particular needle 26.

For example, member 48 may provide a high speed yarn end 40 to the needle 26 while members 50,52 provide slower speed yarn ends 42,44. When caught by a looper attachment 36 the result can resemble FIG. 3. The respective tensions of yarn ends 40,42,44 result in loops 58,60,62 with loop 58 created by yarn end 40 and loops 60,62 created by yarn ends 42,44.

When the color or other physical characteristic of yarn end 40 differs from any of yarn ends 42,44, a design and/or repeat can be created. For instance, if yarn end 40 is red, yarn end 42 is blue and yarn end 44 is white, upon tufting a fabric F, red from loop 58 would be predominant on the stitch of FIG. 3 since it is closer to a viewer from above.

Depending upon the sophistication of the yarn feed attachment or tension device, the elevated yarn ends 40,42, 44 and thus color or colors relative to others passing through needle 26 can be selected for a design and/or pattern. While only one loop 58 is illustrated elevated relative to the other loops 60,62, it is possible to elevate more than one loop 58 and/or provide a plurality of elevations with at least one loop 58 being the relatively most elevated compared to others of the plurality, proceeding through needle 26.

Figure 4:
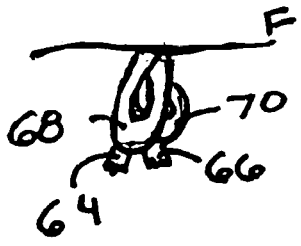
FIG. 4 shows a multi-pile height looper used in conjunction with the present invention.

FIG. 4 shows another example of yarn ends 40,42,44 after having encountered a cut/loop looper with cut loop ends 64,66 (having been cut) end loops 68,70. Cut loop ends 64,66 were fed from yarn end 40, at a higher speed (lower tension) and then cut. Loops 68,70 were fed at a lower speed (higher tension) and thus were not cut by the cut/loop looper. The cut loop ends 64,66 provide a different appearance in the finished fabric F than the uncut loops 68,70. By programming selecting the speeds of members 48,50,52 and/or tensions on ends 40,42,44 the particular yarn ends 40,42,44 cut, or not cut can be selected to provide a desired pattern and/or repeat.

Figure 3:
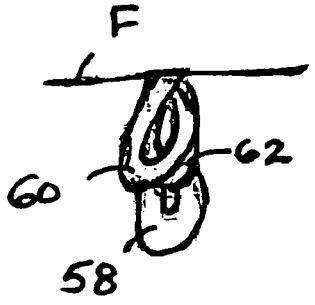
FIG. 3 shows a cut/loop looper utilized in conjunction with the apparatus shown in FIG. 2.

Although only one yarn end 40 is illustrated in lower tension than yarn ends 42,44 in FIGS. 3 and 4, it will be understood that a plurality of lower tension yarn ends 40 could be fed through needle 26. Also a variety of tensions other than just high/low (i.e., such as high, medium, low) could be selected.

Repeats can be established by providing a member 48 which provides yarn ends 40 to a plurality of needles spaced from one another across the width of a tufting machine 10. Non-repeating designs may be created especially when utilizing yarn feed attachments which individually control yarn tension.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A tufting machine receiving yarn ends from a yarn supply through a yarn tension device comprising:

a first needle;

a plurality of yarn ends fed from a yarn supply through a yarn tension device to the first needle;

at least one of the plurality of yarn ends fed at least selectively at a higher speed than others of the plurality of yarn ends; and and a looper mechanism;

wherein the at least one of the yarn ends is selectively tufted to a higher height than the others of the plurality of yarn ends when tufted through a fabric.

2. The tufting machine of claim 1 wherein the looper mechanism further comprises a cut/loop looper.

3. The tufting machine of claim 1 wherein the looper mechanism further comprises a hook.

4. The tufting machine of claim 1 wherein at least one of the plurality of yarn ends fed to the first needle has at least one of a different color and a different texture than the others of the plurality of yarn ends.

5. The tufting machine of claim 1 further comprising a yarn tension device which selectively feeds the at least one of the yarn ends at the higher speed.

6. The tufting machine of claim 5 wherein the yarn tension device independently controls tension on each of the yarn ends proceeding through the needle.

7. The tufting machine of claim 6 wherein the yarn tension device is utilized to create at least one of a design and a repeat by selectively elevating a first yarn end of the plurality of yarn ends, and then a second yarn end of the plurality of yarn ends to create the at least one of the design and the repeat.

8. The tufting machine of claim 6 wherein the yarn tension device further comprises yarn tension device members selectively feeding yarn at at least two speeds to the first needle.

9. The tufting machine of claim 1 further comprising a plurality of needles with the first needle being one of the plurality of needles.

10. A textile machine comprising:

a yarn tensioning device configured to selectively apply tension to a plurality of yarn tension members;

a first needle, said first needle one of a plurality of needles;

a plurality of yarn ends fed from a yarn supply through the yarn tension device to the first needle with at least two of the yarn ends fed from separate yarn tension members;

at least one of the plurality of yarn ends fed at least selectively at a higher speed than others of the plurality of yarn ends; and and a looper mechanism;

wherein the at least one of the plurality of yarn ends extends a higher height than the others of the plurality of yarn ends when provided through a fabric by the first needle.

11. The textile machine of claim 10 wherein the textile machine is a tufting machine.

12. The textile machine of claim 10 wherein the looper mechanism further comprises at least one of a hook and a cut/loop looper.

13. The textile machine of claim 10 wherein at least one of the plurality of yarn ends fed to the first needle has at least one of a different color and a different texture than the others of the plurality of yarn ends.

14. The tufting machine of claim 10 wherein the yarn tension device is utilized to create at least one of a design and a repeat by selectively elevating a first yarn end of the plurality of yarn ends, and then a second yarn end of the plurality of yarn ends to create the at least one of the design and the repeat.

* * * * *